United States Patent [19]

Rand

[11] 4,029,517

[45] June 14, 1977

[54] VAPOR DEGREASING SYSTEM HAVING A DIVIDER WALL BETWEEN UPPER AND LOWER VAPOR ZONE PORTIONS

[75] Inventor: Burton Rand, Norristown, Pa.

[73] Assignee: Autosonics Inc., Norristown, Pa.

[22] Filed: Mar. 1, 1976

[21] Appl. No.: 662,750

[52] U.S. Cl. ..... 134/11; 68/18 C; 134/12; 134/40; 134/105; 134/109; 202/170

[51] Int. Cl.[2] ..... B08B 5/00

[58] Field of Search ..... 134/11, 12, 31, 35, 134/40, 105, 109, 135; 68/18 C; 34/73; 202/170

[56] References Cited

UNITED STATES PATENTS

| | | | |
|---|---|---|---|
| 2,091,182 | 8/1937 | Mitchell | 202/170 |
| 2,371,394 | 3/1945 | Hunter et al. | 202/170 |
| 2,385,564 | 9/1945 | Booth et al. | 202/170 X |
| 3,772,082 | 11/1973 | Dunn, Jr. | 134/11 X |

*Primary Examiner*—S. Leon Bashore
*Assistant Examiner*—Richard V. Fisher
*Attorney, Agent, or Firm*—Seidel, Gonda & Goldhammer

[57] ABSTRACT

Cleaning apparatus such as a degreaser tank is provided with a vapor zone divided into upper and lower portions by a wall and a closure member which cooperates with the wall so that the upper and lower portions of the vapor zone may be isolated from one another. During such isolation of the upper and lower portions of the vapor zone, vapors from the upper portion are removed to thereby facilitate introduction or removal of work pieces into the upper portion of the vapor zone while minimizing solvent losses to the atmosphere and minimizing exposure of workers to solvent vapors.

16 Claims, 1 Drawing Figure

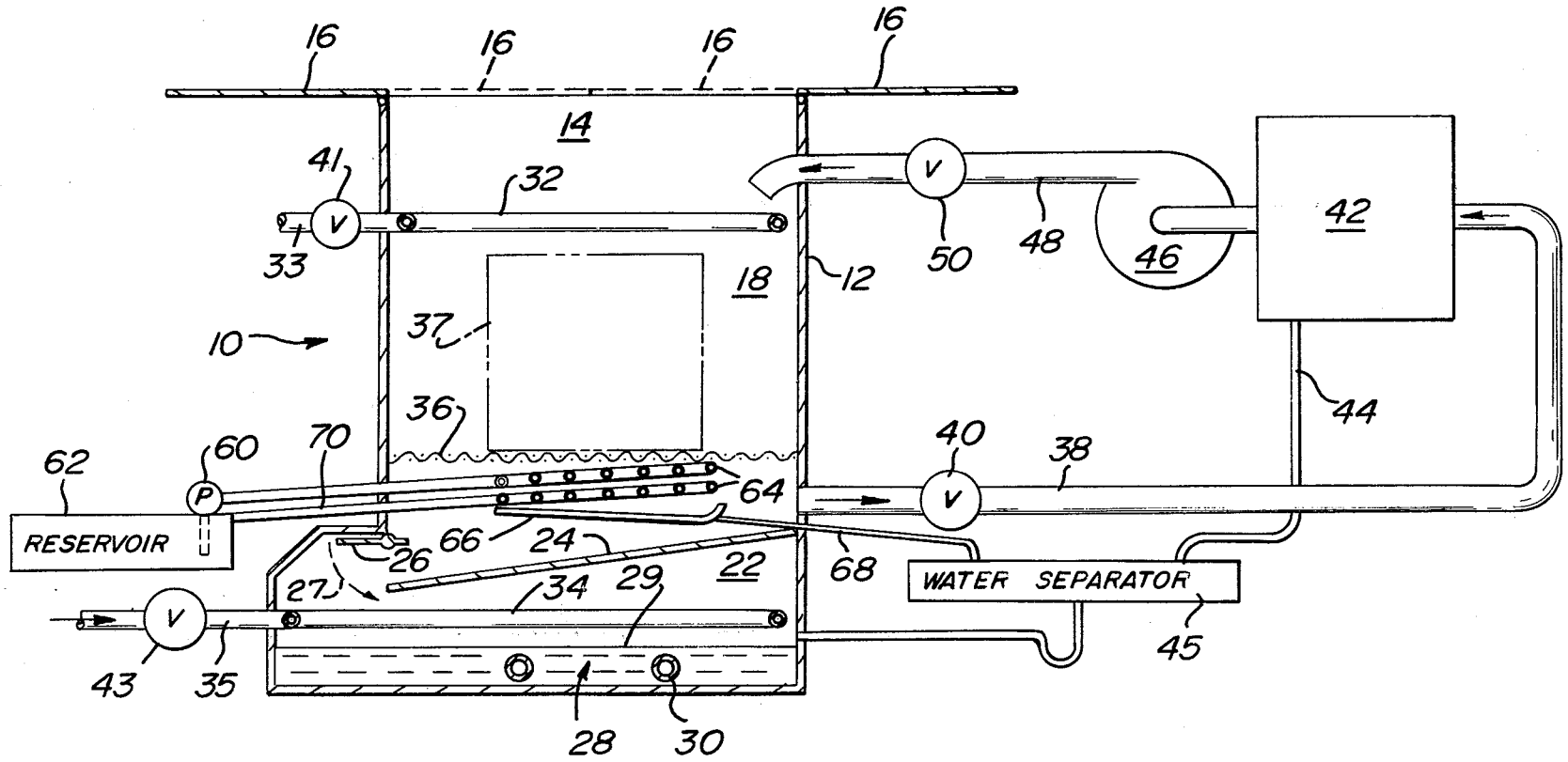
WATER SEPARATOR
RESERVOIR

VAPOR DEGREASING SYSTEM HAVING A DIVIDER WALL BETWEEN UPPER AND LOWER VAPOR ZONE PORTIONS

BACKGROUND

A large number of patents have issued directed to cleaning apparatus such as degreaser tanks. For example, see my U.S. Pat. Nos. 3,375,177; 3,078,701 and 3,049,904.

Loss of vapor is a pollution hazard to operating personnel as well as being an economic loss. Regardless of whether the degreasing tank has a cover or is open, there is a loss of vapor when the parts being cleaned are removed from within the degreasing tank due to solvent in the form of vapor or liquid which adheres to the parts. The present invention seeks to minimize vapor losses by a structural interrelationship of the components of the cleaning apparatus.

The cleaning apparatus of the present invention preferably takes the form of a degreaser tank comprising a housing adapted to have a vaporizable solvent in a sump in the housing. A first condensor means is supported by the housing and defines the upper end of a vapor zone in the housing which extends downwardly to the sump. The housing is provided with a wall dividing the vapor zone into upper and lower portions. The upper portion of the vapor zone has said first condensor means adjacent the upper end thereof.

A means is provided within the housing for cooperation with a portion of the dividing wall to thereby provide selective communication between the upper and lower portions of the vapor zone. A means is provided above the wall for supporting a work piece within the upper portion of the vapor zone. A second condensor means is supported by the housing in the lower portion of the vapor zone. A means is provided in connection with the upper portion of the vapor zone for separating vaporized solvent from air.

The separating means has an inlet connected by a first means with the upper portion of the vapor zone. An outlet of the separating means communicates with the upper portion of the vapor zone by way of a second means. A means such as a blower selectively causes circulation of air and vaporized solvent from the upper portion of the vapor zone through the first means to the separating means which discharges desaturated air to the upper portion of the vapor zone through the second means.

The separating means is preferably in an inoperative or idling state until it is desired to remove a work load from the upper portion of the vapor zone. The upper and lower portions of the vapor zone are isolated from one another prior to circulation of vapor and air from the upper portion of the vapor zone through the separating means.

It is an object of the present invention to provide a novel cleaning apparatus for minimizing loss of vaporizable solvent.

It is another object of the present invention to provide degreasing apparatus which reduces solvent vapors in the cleaning area to the lowest practical level before loading or unloading of parts to be cleaned.

It is another object of the present invention to provide cleaning apparatus which is simple and reliable.

Other objects will appear hereinafter.

The drawing illustrates schematically a cleaning apparatus in accordance with the present invention.

Referring to the drawing in detail, wherein like numerals indicate like elements, there is shown a cleaning apparatus in accordance with the present invention designated generally as 10.

The apparatus 10 includes a vessel 12 such as a degreasing tank. The vessel 12 adjacent the upper end 14 may be provided with one or more covers 16. As illustrated, each of the covers is adapted to overlie one half of the upper end 14 of the tank 12.

Within the tank 12, there is provided a vapor zone divided into an upper portion 18 and a lower portion 22 by a divider wall 24. The divider wall 24 is preferably sloped as illustrated so as to facilitate drainage of condensed vapors. A movable closure member 26 is supported by the housing. Closure member 26 is adapted to be rotated manually in the direction of arrow 27 from the open position illustrated to a position wherein it cooperates with the lefthand end of wall 24 to isolate or valve off the upper portion 18 of the vapor zone from the lower portion 22 of the vapor zone.

Below the wall 24, the housing 12 contains a sump 28 having a supply of a vaporizable solvent 29. Any one of a wide variety of solvents vaporizable and/or sprayable with or without heat may be utilized. Within the sump 28, there is provided an electrical heater coil 30. A preferred solvent is methylene chloride which boils at 104° F. and is easily controlled.

A first condensor means 32 comprised of one or more condensor tubes is provided in the housing 12 to define the upper end of the upper portion 18 of the vapor zone. A similar second condensor means 34 is provided below wall 24 so as to be in the lower portion 22 of the vapor zone. The condensor means 32, 34 are provided with conduits 33, 35 respectively for selectively introducing a coolant therethrough. Conduit 33 has a valve 41 and conduit 35 has a valve 43. Above the wall 24, the housing 12 is provided with any suitable support means so as the work support 36 on which can be supported the work 37. The work 37 may be a perforated container in which metal objects are located and adapted to be cleaned and/or degreased. Suitable reinforcing structure may be provided for the work support 36 so that it may support the load of the work 37. The cover 16 preferably can be moved to an open disposition so that work 37 may be introduced or removed from the vapor chamber by a hoist. In this regard, the covers 16 are shown in an open position to illustrate that the complete upper end 14 of the tank 12 is exposed and available for introduction or removal of the work 37.

A conduit 38 having a valve 40 has one end connected to the tank 12 above the elevation of the wall 24 so as to preferably communicate with the lower end of the upper portion 18 of the vapor zone. The other end of conduit 38 is connected to the inlet of a separating means 42. Separating means 42 may be a chiller, adsorber, or other device for separating air from solvent vapors. Condensed solvent is transmitted from the separating means 42 through a water separator 45 to the sump 28 by way of conduit 44.

The outlet of the separating means 42 communicates with the inlet of blower 46. The outlet of the blower 46 preferably communicates with the upper end of the upper portion 18 of the vapor zone by way of branch conduit 48 having valve 50.

A typical manner in which the apparatus 10 may be used is as follows. Work 37 is lowered into the vessel 12 by a hoist or the like. The covers 16 are closed. Closure member 26 is manipulated to the position shown. A coolant such as cold water above freezing temperature is circulated from conduit 33 through the first condensor means 32. There is no flow through or coolant in condensor means 34. Solvent 29 is vaporized to create vapors which rise and occupy the vapor zone defined by the upper and lower portions 18 and 22. When the vapors reach the elevation of first condensor means 32, they flow towards it and condense. The condensed vapors flow back to sump 28.

After the work 37 has been subjected to the vapors of the vapor zone for a sufficient period of time, valve 43 is opened and a coolant is introduced into the second condensor means 34 from conduit 35. The flow of a coolant through condensor means 34 will draw vapors from the upper portion 18 to the lower portion 22 of the vapor zone. If heaters 30 are being used, they are shut off. After a sufficient period of time has elapsed, closure member 26 is moved to a closed position thereby isolating the upper portion 18 from the lower portion 22. Thereafter, valves 40 and 50 are opened. The blower 46 is started.

A mixture of residual vaporized solvent and air flows from the upper portion 18 through conduit 38 to the separating means 42. The separating means 42 separates the mixture into desaturated air and liquid solvent. The liquid solvent drains by way of conduit 44 to the sump 28. The blower 46 returns the air preferably to the upper end of the upper portion 18 of the vapor zone by way of conduit 48 and creates turbulence in said portion 18. After a predetermined period of time which varies with the size of the unit, the upper portion 18 of the vapor zone and the work 37 are completely devoid of solvent vapors. Thereafter, the cover 16 may be opened and the load 37 removed by the hoist or the like. It will be noted that during the circulation of air from the upper portion 18 of the vapor zone, the upper portion 18 is isolated from the lower portion 22 by way of wall 24 and closure member 26.

To expedite processing the next batch, the coolant in condensor means 34 should be removed before opening closure member 26. This may be attained by using a vent valve in conduit 35 whereby the condensor means 34 is vented to a drain by way of the valve 43 when the valve 43 is moved to closed position. Thereafter, the above process is repeated.

When the work 37 is free draining and there is no tendency of vapors being entrained therein or thereon, such as pieces of sheet metal, then the separating means 42 need not be used to remove the residual vapors. Instead of turning on the blower 46 to commence with circulation of the air and residual vapors to means 42 in the above sequence of operation, pump 60 may be turned on to pump refrigerated coolant from the refrigerated reservoir 62 to the condensor coils 64 which feed back to the reservoir 62.

Since the hot vapors have already been drawn into portion 22 by condensor means 34, the hot residual vapors are drawn to condensor coils 64, condense thereon and drip into tray 66. Tray 66 communicates with sump 28 by way of trap conduit 68 and water separator 45. As soon as the residual vapors have condensed, pump 60 is shut off and the coolant in coils 64 drains by gravity to the reservoir 62 through a pump bypass and through the outlet conduit extending from the coils 64 to reservoir 62.

If desired, one or both of the mating faces of the covers 16 may be provided with a deformable portion to embrace a hoist chain or strap. In that event, work 37 may be suspended from the hoist while in portion 18 of the vapor zone and yet the covers 16 may be moved to a closed disposition.

If the teachings of my aforesaid U.S. Pat. No. 3,375,177 are followed, the cover 16 may be eliminated. Nevertheless, the covers 16 do perform a useful function in preventing the introduction of contaminated air into the vessel 12 during the recycling of vapors from the upper portion 18 of the vapor zone through the separating means 42 and for containing the turbulence in vessel 12 due to said recycling of vapors. Containing such turbulence by cover 16 is very desirable when using higher boiling temperature solvents such as perchlorethylene.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising a housing having a sump adapted to contain a vaporizable solvent, a first condensor means supported by the housing adjacent the upper end thereof and defining the upper end of a vapor zone in said housing above said sump, dividing means for dividing the vapor zone into upper and lower portions and for selectively isolating said portions, the upper portion of the vapor zone having said first condensor means adjacent the upper end thereof, second condensor means supported by said housing in said lower portion of said vapor zone below said dividing means, means for separating vaporized solvent from air containing said vaporized solvent, said separating means having an inlet and an outlet, first means providing communication between said upper portion of said vapor zone and the inlet of said separating means, second means providing communication between the outlet of said separating means and said upper portion of said vapor zone, and means for selectively causing circulation of air and vaporized solvent from the upper portion of said vapor zone through said first means to said separating means and for discharging desaturated air to the upper portion of said vapor zone by way of said second means.

2. Apparatus in accordance with claim 1 including means for supporting a work piece in said housing in said upper portion of the vapor zone, said dividing means including a wall extending across said vapor zone below the elevation of said means for supporting a work piece and movable means cooperating with a portion of said wall for selectively controlling communication between said upper and lower portions of said vapor zone.

3. Apparatus in accordance with claim 2 wherein said wall is angularly disposed so as to direct flow of condensed solvent from said portion of said wall into the sump.

4. Apparatus in accordance with claim 2 including a selectively operable third condensing means disposed between said workpiece support and said dividing wall.

5. Apparatus in accordance with claim 1 including a movable cover on the upper end of said housing.

6. Apparatus comprising a housing having a sump adapted to contain a vaporizable solvent, a first condensor means supported by the housing adjacent the upper end thereof and defining the upper end of a vapor zone in said housing, a second condensor means in said housing above the sump, a dividing wall at an elevation between the elevation of said first and second condensor means, a movable closure member cooperating with said wall and movable between opened and closed positions for providing selective communication between an upper portion of the vapor zone above the elevation of said wall and a lower portion of the vapor zone below said wall, and means connected to said housing above the elevation of said wall for removing residual vaporized solvent from the upper portion of said vapor zone and returning condensate thereof to said sump when said closure member is in its closed position and the upper portion of vapor zone is isolated from the lower portion of the vapor zone.

7. Apparatus in accordance with claim 6 wherein said first and second condensor means are discrete from one another and have separately controlled valves for independent operation.

8. Apparatus in accordance with claim 6 wherein said wall is disposed at an angle so as to have one end at a higher elevation than the opposite end, said opposite end of said wall being the portion cooperating with said closure member.

9. Apparatus in accordance with claim 6 including a cover movably supported at the upper end of said housing for exposing the entire upper end of the housing, and means within said housing above the elevation of said wall for supporting a work piece to be cleaned.

10. Apparatus in accordance with claim 9 including a selectively operable third condensing means disposed between said workpiece support and said dividing wall.

11. Apparatus comprising a housing having a sump in a lower end thereof and adapted to contain a vaporizable solvent, and means in said sump for heating a solvent, said heating means being capable of vaporizing said solvent, a cover movably supported on the upper end of said housing to facilitate entry and removal of a work piece from said housing, a first condensor means supported by the housing and defining the upper end of a vapor zone extending downwardly therefrom to the sump, a dividing wall in the housing for dividing the vapor zone into upper and lower portions, the upper portion of said vapor zone having said first condensor means adjacent the upper ends thereof, a closure member cooperating with a portion of said wall for providing selective communication between the upper and lower portions of said vapor zone, means above the elevation of said wall for supporting a work piece within said upper portion of said vapor zone, a second condensor means supported by said housing in said lower portion of said vapor zone, each condensor means being discrete and independent of the other condensor means, a separating means for separating and condensing vaporized solvent from air containing the vaporized solvent, said separating means having an inlet communicating by way of a first conduit means with said upper portion of said vapor zone adjacent to but above the elevation of said wall, second conduit means extending from an outlet of said separating means to the upper end of said upper vapor zone, each of said first and second conduit means having a selectively operable valve therein, and a third conduit means extending from said separating means to said sump for return of solvent condensed by the separating means.

12. Apparatus in accordance with claim 11 wherein said closure member rotates between open and closed positions.

13. Apparatus in accordance with claim 11 including a selectively operable third condensing means disposed between said workpiece support and said dividing wall.

14. A method of cleaning comprising:

a. introducing work to be cleaned into a housing having a vapor zone divided into an upper portion and a lower portion, said upper and lower portions being in communication with each other, said work being introduced into said upper portion of said vapor zone;

b. introducing vaporized solvent into each portion of said vapor zone, cleaning said work by contact with said vapors;

c. using an upper condensor means to limit the upper extent of said vapor zone;

d. introducing a coolant into a lower condensor means located in said lower portion of said vapor zone when the work is cleaned, drawing hot vapors from the upper portion of said vapor zone into said lower portion of said vapor zone by said lower condensor means;

e. interrupting communication between said portions of said zone;

f. removing residual vapors from said upper portion of said zone and from said work; and g. removing said work from said upper portion of said zone.

15. A method in accordance with claim 14 wherein step (f) includes introducing a refrigerated coolant into third condensor means located in said upper portion of said zone but below the elevation of said work.

16. A method in accordance with claim 14 wherein step (f) includes separating the residual vapors from the air carrying said vapors, and returning desaturated air to said upper portion of said zone.

* * * * *